US006321578B1

(12) United States Patent
Apollonio

(10) Patent No.: US 6,321,578 B1
(45) Date of Patent: Nov. 27, 2001

(54) METHOD AND APPARATUS FOR TRANSFERRING A LOOP FROM A SELECTED NEEDLE TO AN ADJACENT NEEDLE FOR CREATING A DECORATIVE OPEN-WORK PATTERN WITH NO-RUN STITCH AND LOOP TRANSFER KNITTING NEEDLE

(76) Inventor: Francesco Gavagnin Apollonio, 510 19th Ave. Dr., NW., Hickory, NC (US) 28601

( * ) Notice: Subject to any disclaimer, the term of this patent is extended or adjusted under 35 U.S.C. 154(b) by 0 days.

(21) Appl. No.: 09/796,010

(22) Filed: Feb. 28, 2001

(51) Int. Cl.[7] ..... D04B 9/02; D04B 35/02

(52) U.S. Cl. ..... 66/215; 66/58; 66/123; 66/116; 66/121

(58) Field of Search ..... 66/8, 121, 123, 66/120, 116, 46, 51, 95, 37, 13, 30, 58, 173, 215

(56) References Cited

U.S. PATENT DOCUMENTS

| | | | | |
|---|---|---|---|---|
| 2,076,896 | * | 4/1937 | Jones | 66/123 |
| 2,188,125 | * | 1/1940 | Wigley | 66/123 |
| 2,292,940 | * | 8/1942 | Holmes et al. | 66/123 |
| 2,780,082 | * | 2/1957 | Zeruneith | 66/123 |
| 2,953,914 | * | 9/1960 | Zeruneith | 66/123 |
| 2,997,865 | * | 8/1961 | Philp | 66/123 |
| 3,110,167 | * | 11/1963 | Parthum | 66/123 |
| 3,584,481 | * | 6/1971 | Hayashi | 66/120 |
| 3,609,998 | * | 10/1971 | Mutze et al. | 66/123 |
| 3,838,583 | * | 10/1974 | Rumi et al. | 66/95 |
| 4,612,786 | * | 9/1986 | Perotti | 66/121 |
| 6,085,554 | * | 7/2000 | Apollonio | 66/123 |
| 6,089,045 | * | 7/2000 | Apollonio | 66/13 |
| 6,170,299 | * | 1/2001 | Apollonio | 66/13 |

FOREIGN PATENT DOCUMENTS

446670 * 4/1936 (GB) .
1246449 * 10/1989 (JP) .

* cited by examiner

*Primary Examiner*—Danny Worrell
(74) *Attorney, Agent, or Firm*—Adams, Schwartz & Evans, P.A.

(57) ABSTRACT

A method for creating an opening in tubular knitted fabric articles on a machine including a needle cam mounted for reciprocal movement between first and second vertically-spaced positions. In the first position the needle cam lowers successive needles to a position where the loop of yarn is released from a selected loop-forming needle and transferred to a transfer needle. In the second position the needle cam lowers successive needles to a position where the loop of yarn is transferred to a transfer needle adjacent the selected loop forming needle without being released from the selected loop-forming needle to thereby form a no-run stitch in the knitted fabric. A needle is selected from which a loop is to be transferred and the loop is enlarged on the selected needle by deflecting the loop out of the vertical plane of the selected needle laterally into the vertical plane of an adjacent needle while the adjacent needle is in a lowered, non-interfering position relative to the deflected loop. The adjacent needle extends upwardly into the enlarged loop. When the needle cam is in the first position, the selected needle is removed from the deflected loop, whereby the loop is transferred to the adjacent needle thus creating an opening in the fabric. When the needle cam is in the second position, the deflected loop is retained on the selected needle while the loop is also transferred to the adjacent needle thus creating a no-run opening in the fabric. A needle suitable for carrying out the loop transfer is also disclosed.

20 Claims, 9 Drawing Sheets

METHOD AND APPARATUS FOR TRANSFERRING A LOOP FROM A SELECTED NEEDLE TO AN ADJACENT NEEDLE FOR CREATING A DECORATIVE OPEN-WORK PATTERN WITH NO-RUN STITCH AND LOOP TRANSFER KNITTING NEEDLE

TECHNICAL FIELD AND BACKGROUND OF THE INVENTION

The present invention generally relates to circular and flat knitting machines capable of manufacturing apparel, including hosiery and like articles. More particularly, the invention relates to a method and apparatus for transferring a loop or loop from a selected needle to an adjacent needle by enlarging the loop on the selected needle and then inserting the other needle through the enlarged loop before the selected needle releases the loop. The term loop is used below to define the segment of yarn being manipulated by the needles, but the term "stitch" can be used interchangeably. This application also discloses an apparatus and method whereby a no-run and conventional stitch pattern can be changed during machine operation by altering the position of a cam, or by having two cams in operation at the same time. By the term "no-run" is meant a stitch with an interlocking feature that prevents a hole from enlarging along a length knitted fabric, and is synonymous with the terms run-proof and run-less. This type of stitch provides knitted products, particularly stocking or pantyhose products, extra life. As disclosed herein, a no-run stitch is also used in combination with a conventional stitch to provide additional patterning possibilities.

This application also discloses a needle specifically designed to facilitate loop transfer in the apparatus and method described below.

Circular knitting machines knit together multiple strands of yarn into a tubular fabric, hosiery blank or other structure. The hosiery blank is then finished according to conventional processes to create finished hosiery articles, such as socks, hose and stockings. Such machines include a plurality of needles positioned in axial slots formed in an exterior surface of a rotatable needle cylinder. Each needle includes a shank having opposed ends. A hook is formed in a top end of the needle shank and a butt is formed in the bottom end of the needle shank. A plurality of sinkers are mounted in a sinker ring positioned on a top end of the needle cylinder such that the sinkers are alternately positioned between the needles. Circular knitting machines also include a feeder mechanism that delivers yarn onto the passing needles. The yarn forms a loop or loop around each needle.

Flat bed knitting machines carry out similar functions on a flat bed, forming a flat fabric which can then be formed into drapes, garments or many other products.

Hosiery articles with decorative patterns formed by open-work in the fabric created by transferred knitting loops is old and conventional. The space not occupied by the transferred loop creates a hole in the fabric, and the pattern of holes in the fabric collectively create the desired decorative effect. Heretofore such designs have been limited to relatively coarse gauge fabrics due to the difficulty in transferring very small loops between fine gauge needles. Thus, there is a need for a knitting machine and method which permits the creation of decorative open-work patterns in fine gauge knitted fabric, including fine gauge fashion hosiery, such as tights, pantyhose and similar articles, particularly with the capability to create no-run stitches.

For example, U.S. Pat. No. 3,838,583 to Rumi et al. discloses apparatus which modifies a circular knitting machine so that it can create openings with transfer loops. The Rumi apparatus includes a dial plate eccentrically positioned over and internal to a needle cylinder and a planetary gear eccentrically positioned over and external to the needle cylinder. The upper surface of the dial plate is provided with a plurality of internal punches slidable in a radial direction, and the upper surface of the planetary gear is provided with a plurality of external punches slidable in a radial direction. The internal punches are inclined suitably in the direction opposite of the direction of rotation. Devices are provided to control the axial movement of the internal and external punches and cam means are provided to raise the needles to the level of the punches. Finally, a plurality of movable sinkers are positioned on the needle cylinder and each partially surround one of the needles. The strands of yarn loop around the needles and extend over the sinkers.

In operation, the selectors raise a specified needle or group of needles past their normal working position. The loop on the needle catches on a needle shoulder which raises the loop above the sinker surrounding the needle. The sinker, which has an end hook, then advances and its hook enters the loop causing the loop to enlarge. Immediately afterwards, either of the two punches enter the loop by passing adjacent to an undercut in the needle. The needle is then returned to its normal position leaving the loop on the punch. The punch transports the loop to the intended needle which is raised up through the loop. That needle continues to rise until the loop is removed from the punch and then returns to its normal position. If the internal punch is used, the loop is transferred to the needle preceding the needle from which the loop was taken. If the external punch is used, the loop is transferred to the needle following the needle from which the loop was taken.

The Rumi apparatus, like other existing apparatus used for transferring loops, first removes the loop from the selected needle and then transfers that loop to the following needle. This practice can only be used effectively on coarse gauge knitting machines. Having the distance from one needle to another of 2.35 mm or greater prevents the apparatus from reliably transferring the loop because of the small size of the needles and loops on knitting machines operating with distances between needles of less than 2.35 mm, or 120 needles in a cylinder diameter of 3½ inches. A missed transfer creates a defect which results in a less than first-quality product. The missed transfer problem is naturally exacerbated when the diameter of the needle cylinder is decreased and/or the number of needles being operated is increased.

Consequently, transfer loops cannot be reliably made on prior art fine gauge circular knitting machines. A need, therefore, exists for a method and apparatus for effectively transferring loops from a selected needle to an adjacent needle without dropping a loop and without creating other defects in hosiery articles manufactured on a circular knitting machine capable of creating fine gauge articles.

SUMMARY OF THE INVENTION

Therefore, it is an object of the invention to provide a method and apparatus for reliably transferring loops to create hosiery having a pattern of small openings which collectively create a decorative appearance to the fabric. Unlike existing methods and apparatus, the present invention enables open-work patterns to be formed in very fine gauge hosiery created on, for example, circular knitting machines operating 120 or more needles positioned on a needle cylinder having a diameter of 3.5 inches or less. The invention is capable of being used on any gauge machines with as little as 1 mm spacing between needles.

It is another object of the invention to provide a method for virtually error-free transfer of a loop from a selected needle to a following needle on a circular knitting machine, including but not limited to a fine gauge circular hosiery knitting machine, such as one having 120 or more needles positioned on a needle cylinder having a diameter of 3.5 inches or less.

It is another object of the invention to provide a method of transferring a loop from a selected needle to a following needle by securing the loop on the following needle before the selected needle releases the loop.

It is another object of the invention to provide a method of knitting a tubular fabric using an adjustable cam which permits both an open stitch and a transfer/retain stitch in the same course.

A further and more particular object of the invention is to provide a method and apparatus for transferring a loop from a selected needle to a following needle by widening the loop on the selected needle, inserting the following needle through the widened loop, and only then removing the selected needle from the widened loop thereby causing the selected needle to release the loop.

Another object of the invention is to provide an apparatus for performing the transfer loop operation.

Another object of the invention is to provide enlarging means and cam means for performing the transfer loop operation.

These and other objects of the present invention are achieved in the preferred embodiments disclosed below by providing a method for creating an opening in tubular knitted fabric articles, comprising the steps of providing a knitting machine having a plurality of needles mounted in axial needle slots in a needle cylinder, each of the needles having a hook formed in a top end of a needle shank and a latch pivotally mounted on the needle shank below the hook for opening and closing the hook, and including deflector means for deflecting a loop of yarn being formed by a needle into the vertical plane of an adjacent needle, and a needle cam mounted for reciprocal movement between first and second vertically-spaced positions. In the first position the needle cam lowers successive needles to a position where the loop of yarn is released from a selected loop-forming needle and transferred to a transfer needle. In the second position the needle cam lowers successive needles to a position where the loop of yarn is transferred to a transfer needle adjacent the selected loop forming needle without being released from the selected loop-forming needle to thereby form a no-run stitch in the knitted fabric. A needle is selected from which a loop is to be transferred and the loop is enlarged on the selected needle by deflecting the loop out of the vertical plane of the selected needle laterally into the vertical plane of an adjacent needle while the adjacent needle is in a lowered, non-interfering position relative to the deflected loop. The adjacent needle extends upwardly into the enlarged loop. When the needle cam is in the first position, the selected needle is removed from the deflected loop, whereby the loop is transferred to the adjacent needle thus creating an opening in the fabric. When the needle cam is in the second position, the deflected loop is retained on the selected needle while the loop is also transferred to the adjacent needle thus creating a no-run opening in the fabric.

According to one preferred embodiment of the invention, the method comprises the steps of creating a predetermined open-work pattern representing a desired pattern of openings in a tubular knitted fabric, and carrying out the steps of the method according to the predetermined pattern thereby creating a tubular knitted fabric having an open-work pattern corresponding to the predetermined pattern.

According to another preferred embodiment of the invention, the machine comprises a fine gauge tubular knitting machine suitable for knitting pantyhose.

According to another preferred embodiment of the invention, the machine comprises a fine gauge knitting machine suitable for knitting flat fabric suitable for garments, draperies and the like.

According to yet another preferred embodiment of the invention, the knitting machine is a fine guage machine with a range of cylinder diameter having the needles up to 1 mm apart from each other.

According to yet another preferred embodiment of the invention, the step of enlarging the loop on the selected needle comprises the step of moving the selected needle relative to the loop of yarn from the direction of the top of the needle to the bottom of the needle and past a progressively sloping loop contact surface.

According to yet another preferred embodiment of the invention, the progressively sloping contact surface comprises a deflector integrally formed on the shank of the needle and extending laterally outwardly from the needle shank towards an adjacent needle.

According to one preferred embodiment of the apparatus according to the invention, the apparatus comprises a knitting machine having a plurality of needles mounted in axial needle slots in a needle cylinder, each of the needles having a hook formed in a top end of a needle shank and a latch pivotally mounted on the needle shank below the hook for opening and closing the hook, a deflector for deflecting a loop of yarn being formed by a needle into the vertical plane of an adjacent needle, and a needle cam mounted for reciprocal movement between first and second vertically-spaced positions. In the first position the needle cam lowers successive needles to a position where the loop of yarn is released from a selected loop-forming needle and transferred to a transfer needle. In the second position the needle cam lowers successive needles to a position where the loop of yarn is transferred to a transfer needle adjacent the selected loop forming needle without being released from the selected loop-forming needle to thereby form a no-run stitch in the knitted fabric. When the needle cam is in the first position, removal of the selected needle from the deflected loop transfers the loop to the adjacent needle thus creating an opening in the fabric. When the needle cam is in the second position, the deflected loop is retained on the selected needle while the loop is also transferred to the adjacent needle thus creating a no-run opening in the fabric. A needle selector selects a needle from which a loop is to be transferred, and a deflector carried by the selected needle enlarges the loop on the selected needle by deflecting the loop out of the vertical plane of the selected needle laterally into the vertical plane of an adjacent needle while the adjacent needle is in a lowered, non-interfering position relative to the deflected loop.

The knitting machine includes a pattern controller for storing a predetermined open-work pattern representing a desired pattern of openings in a tubular knitted fabric and selecting needles and transferring loops according to the predetermined pattern to thereby creating a tubular knitted fabric having an open-work pattern corresponding to the predetermined pattern.

According to yet another preferred embodiment of the invention, machine comprises a fine gauge tubular knitting machine suitable for knitting pantyhose.

According to yet another preferred embodiment of the invention, the selected needle includes a progressively sloping loop contact surface.

According to yet another preferred embodiment of the invention, the progressively sloping contact surface comprises a deflector integrally formed on the shank of the needle extending laterally outwardly from the needle shank towards an adjacent needle.

According to yet another preferred embodiment of the invention, the deflector includes an extension extending outwardly and obliquely-downwardly from the needle shank towards a butt end thereof with an arcuate end portion on a distal end portion of the extension for extending around in non-interfering relation to an adjacent sinker. The arcuate end portion has an upper deflector surface terminating without an outwardly projecting stop member.

Another preferred method for creating an opening in tubular knitted fabric articles comprises the steps of providing a knitting machine having a plurality of needles mounted in axial needle slots in a needle cylinder, each of the needles having a hook formed in a top end of a needle shank and a latch pivotally mounted on the needle shank below the hook for opening and closing the hook, and including deflector means for deflecting a loop of yarn being formed by a needle into the vertical plane of an adjacent needle, and first and second needle cams positioned for selectively lowering successive needles to effect loop transfers. The first cam lowers successive needles in accordance with a predetermined pattern to a position where the loop of yarn is released from a selected loop-forming needle and transferred to a transfer needle. The second cam lowers successive needles in accordance with a predetermined pattern to a position where the loop of yarn is transferred to a transfer needle adjacent the selected loop forming needle without being released from the selected loop-forming needle to thereby form a no-run stitch in the knitted fabric. A needle is selected from which a loop is to be transferred, and the loop is enlarged on the selected needle by deflecting the loop out of the vertical plane of the selected needle laterally into the vertical plane of an adjacent needle while the adjacent needle is in a lowered, non-interfering position relative to the deflected loop. The adjacent needle is moved upwardly into the enlarged loop, thus receiving the loop. When the first needle cam lowers the needle, the selected needle is removed from the deflected loop, whereby the loop is transferred to the adjacent needle thus creating an opening in the fabric. When the second needle cam lowers the needle, the deflected loop is retained on the selected needle while the loop is also transferred to the adjacent needle thus creating a no-run opening in the fabric.

According to yet another preferred embodiment of the invention, an apparatus is provided for creating an opening in knitted fabric articles, comprising a knitting machine having a plurality of needles mounted in axial needle slots in a needle cylinder, each of the needles having a hook formed in a top end of a needle shank and a latch pivotally mounted on the needle shank below the hook for opening and closing the hook, and including a deflector for deflecting a loop of yarn being formed by a needle into the vertical plane of an adjacent needle. First and second needle cams are mounted for lowering successive needles to respective loop transfer positions. The first needle cam lowers successive needles to a position where the loop of yarn is released from a selected loop-forming needle and transferred to a transfer needle. The second needle cam lowers successive needles to a position where the loop of yarn is transferred to a transfer needle adjacent the selected loop forming needle without being released from the selected loop-forming needle to thereby form a no-run stitch in the knitted fabric. A needle selector is provided for selecting a needle from which a loop is to be transferred in accordance with a predetermined pattern. A deflector is carried by the selected needle for enlarging the loop on the selected needle by deflecting the loop out of the vertical plane of the selected needle laterally into the vertical plane of an adjacent needle while the adjacent needle is in a lowered, non-interfering position relative to the deflected loop.

A further method according to the invention includes the steps of transferring a loop from a selected needle to a following needle during the operation of a circular knitting machine. As used herein, a selected needle is a needle from which the transfer loop is removed, and a following needle is an adjacent needle onto which the transfer loop is placed. It is contemplated by the present invention that the following needle may be either the needle immediately preceding the selected needle with respect to the direction of needle cylinder rotation or the needle immediately succeeding the selected needle with respect to the direction of needle cylinder rotation.

To perform the transfer loop operation, the loop on the selected needle is enlarged or widened. Once the loop on the selected needle is sufficiently enlarged, the following needle is inserted through the enlarged loop such that the loop may then be secured around the following needle. Finally, the selected needle is removed from the enlarged loop thereby causing the selected needle to release the loop. As a result, the loop is completely transferred from the selected needle to the following needle and a controlled perforation is formed in the hosiery article. A pattern of openings may be formed in the hosiery article by selecting needles in accordance with a pre-determined set of instructions.

The apparatus for performing the invented method includes means for enlarging the loop on the selected needle and cam means for controlling the movement of the needles to effectuate the transfer of the selected loop from the selected needle to the following needle.

Each needle has a latch positioned below the hook. The latch pivots between a hook closed position in which the distal end of the latch abuts the distal end of the hook and a hook open position in which the latch abuts the shank of the needle and is distally disposed with respect to the hook. The hook and latch of each needle are aligned in a radially outwardly manner with respect to the needle cylinder. The butts formed in the bottom end of each needle extend radially outwardly beyond the circumference of the needle cylinder. The bottom end of each needle abuts a top end of a selector shank which is also positioned in the axial slots of the needle cylinder. The selector shanks each have teeth extending radially outwardly beyond the circumference of the needle cylinder. The top of the hook has a unique profile which facilitates insertion of the hook into the widened loop.

An actuator engages the teeth on the selector shanks and vertically moves particular needles according to a pre-programmed set of instructions. Typically, the actuator is controlled by a computer which repeatedly selects a particular group of needles to create a desired pattern of openings in the hosiery article being formed.

In a preferred embodiment, the loop-enlarging means is a deflector integrally formed with and extending laterally from the shank of each needle at a location below the latch and the cam means includes an upper cam and a lower cam positioned adjacent the exterior surface of the needle cylinder. The deflectors are curved, with a distal region of each deflector extending beyond the plane of the following needle. Finally, the deflectors initially extend radially outwardly, but they then curve radially inwardly toward the longitudinal axis of the needle cylinder. The deflectors are characterized as not requiring a catch or stop for preventing movement of the yarn past the bottom of the deflector.

The lower cam is positioned proximate to the bottom end of the needle cylinder. The lower cam has a gradually upwardly sloping contact surface for guiding the teeth of the selector shanks below the selected needles. Only the selected needles raised by the actuator encounter the contact surface of the lower cam. The lower cam raises the selected needles such that the butts of those needles are properly positioned with respect to the upper cam.

The upper cam preferably includes three members. The first member of the upper cam is positioned above the lower cam and is off-set from the contact surface of the lower cam in the direction of needle cylinder rotation. The second member of the upper cam is positioned above the first member of the upper cam and is generally triangular in shape. The second member of the upper cam has an upwardly sloping upper contact surface for guiding the butts of the selected needles upwardly thereby forcing the selected needles to further rise.

For simplicity of understanding, the following discussion of the operation of the invented apparatus describes one complete rotation of the needle cylinder in which only one needle is selected. There are at least three zones encountered by the needles during each complete revolution of the needle cylinder. The first zone is the loop feed zone in which the feeder mechanism delivers yarn onto the hooks of the needles. The last zone is the loop release zone. Between the loop feed zone and loop release zone is at least one loop transfer zone. Multiple loop transfer zones can be used to either create more complex patterns or transfer loops more than once. As the needles enter a loop transfer zone, the needles are positioned below their respective sinkers and the latches on the needles are in the hook closed position.

In a loop transfer zone, the actuator selects a needle by engaging a tooth on the selector shank below that needle. The actuator raises the selector shank and the selected needle to a position that aligns a tooth on the selector shank with the contact surface of the upper cam. Consequently, the selected needle rises as the selector tooth travels upwardly along the contact surface of the upper cam. This upward movement of the selected needle causes the loop on that needle to slide downwardly past the latch thereby moving the latch down to the hook open position. During this upward movement of the selected needle, the following needle (and all non-selected needles) engage the lower cam which initially maintains the hooks of the non-selected needles below the sinkers.

As the butt of the selected needle travels upwardly along the upper cam, the loop on that needle continues to slide downwardly where it encounters a deflector formed on the shank of the needle. The loop widens as it slides down the deflector. When the butt of the selected needle reaches the apex of the upper cam, the loop is enlarged laterally into the plane of the following needle. As noted above, the stop on the end of the deflector is eliminated by lengthening the needle and not raising the bottom of the flange about the level of the sinkers.

While the butt of the selected needle is traveling along the upper cam, the butt of the following needle engages the lower cam which causes the following needle to rise. The following needle is raised to the extent that the loop on that needle travels far enough down the shank of the needle to move the latch downwardly to the hook open position. The loop, however, does not move past the latch. A downwardly sloping lower contact surface of the upper cam then forces the following needle to move back down below its sinker but the latch on that needle remains down in the hook open position.

Naturally, more than one loop transfer zone can be used to accelerate the loop transfer process and to create more complex open-work patterns in the fabric being formed.

After the needles exit the loop transfer zones, they enter the loop release zone. In the loop release zone all of the needles are first raised to a height sufficient to cause the loops on the needles to slide past the latches and are then lowered down below the sinkers. Consequently, all of the needles release their respective loop. The needles then leave the loop release zone and again rotate past the feeder mechanism where yarns are again placed on all of the needles and the process is repeated.

In a preferred embodiment of a knitting needle according to the invention, the needle has a shank with front and back planes A and D, a hook at a top end of the shank having a highest point B, a front plane C and a diameter, a butt adjacent a bottom end of the shank, a pivotally-attached latch for selectively opening and closing the hook, and a deflector for deflecting a loop of yarn being formed by the needle into the vertical plane of an adjacent needle. The improvement comprises the hook having a dimension B-C approximately twice the diameter of the hook, and a dimension A-B approximately three times the dimension B-C.

Preferably, the ratio of thickness of the hook to the shank is ⅗.

The dimension C-D may be 1.5 times the dimension B-C.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

General Description of Knitting Process

Figure 1:
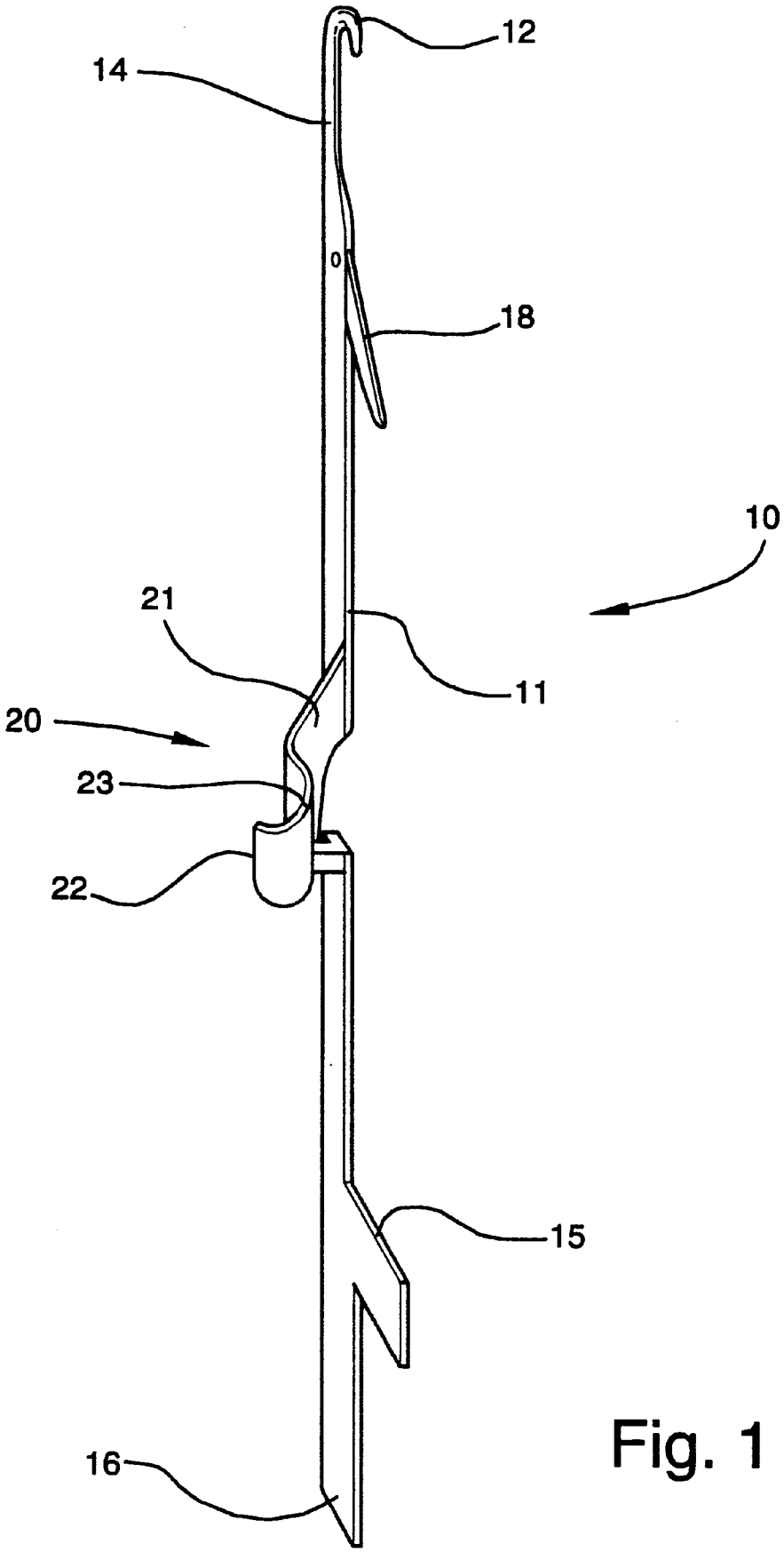
FIG. 1 is perspective view of a needle in accordance with one embodiment of the invention.

The invention takes place on a circular knitting machine modified in accordance with the disclosure below. The knitting machine may be a lace pantyhose machine, or other knitting machine suitable for forming tubular knit fabrics with open-work areas. Such machines typically have a hollow needle cylinder mounted in a housing. The cylinder is rotated by conventional means about its longitudinal axis during fabric formation. A plurality of axial slots are formed in an exterior surface of the needle cylinder and a plurality of needles are slidably mounted in the slots for reciprocating up-and-down movement under the control of mechanical, electro-mechanical or electronic patterning and fabric formation devices. Typically, such patterns are now stored in computer memory, such as random access memory, magnetic media disks or cards, or other electronic devices which can output digital data representing instructions to the knitting elements of the machine to re-create the desired pattern.

A plurality of resilient rings are positioned around the needles and the needle cylinder to maintain the position of the needles in the slots. Due to the rotation of the needle cylinder, the needles revolve about the vertical axis of the needle cylinder. A plurality of sinkers are positioned on a top end of the needle cylinder.

In a loop transfer zone, an actuator selects a needle in a conventional manner and raises the selected needle to a position that aligns the needle butt with a contact surface of the a lower cam. Consequently, the selected needle rises as the butt travels upwardly along the contact surface of the lower cam. This upward movement of the selected needle causes the loop on the selected needle to slide downwardly past the latch of the needle thereby moving the latch down to the hook open position. See FIGS. 1 and 2. The lower cam raises the selected needle to a position in which the butt of the selected needle is aligned with an upper contact surface of the upper cam. During this upward movement of the selected needle, the following needle (and all non-selected needles) engage the lower cam which initially maintains the hooks of the non-selected needles below the sinkers.

As the butt of the selected needle travels upwardly along the upper cam the loop continues to slide downwardly where it encounters the deflector carried on the shank of each needle. The yarn slides down the curved surface of the deflector, which causes the loop to widen. When the butt of the selected needle reaches the apex of the upper cam, the loop is enlarged sufficiently to reside with the plane of vertical movement of the following needle. While the butt of the selected needle is traveling along the upper surface of cam, the butt of the following needle engages a first section of the upper cam which causes the following needle to rise. The following needle is raised to the extent that the loop on that needle travels far enough down the shank of the needle to move the latch downwardly to the hook open position. The loop, however, does not move past the latch. The upper cam then forces the following needle to move back down below its sinker but the latch on the needle remains down in the hook open position.

The cam again raises the following needle. Because the apex of the cam corresponds to the apex of the cam, the following needle rises up through the enlarged loop positioned around the bottom end of the deflector of the selected needle. The hook of the following needle is positioned above the loop, but the distal end of the latch of the following needle remains below the loop. The following needle remains in this position until its butt encounters the contact surface of cam. The second cam and third cam are spaced apart to provide sufficient time for the following needle to rise up through the enlarged loop. The cam is generally shaped like a trapezoid inverted with respect to the cam.

The butt of the selected needle engages the downwardly sloping contact surface of the cam causing the selected needle to move downwardly. The loop slides upwardly on the shank of the selected needle. The loop forces the latch to move upwardly to the hook closed position which prevents the loop from returning into the hook of the selected needle. When the hook of the selected needle moves down below its sinker, the loop is released. The cam forces the selected needle down below the sinker before it forces the following needle to do the same. The loop is caught in the hook of the following needle which is still positioned above its sinker and which still has its latch in the hook open position. Finally, the cam forces all of the needles to move down below their respective sinkers. Naturally, more than one loop transfer zone can be used to accelerate the loop transfer process and to create more complex perforation patterns in the hosiery article being formed.

The above description is exemplary of conventional knitting technique and is therefore not further described or illustrated.

After the needles exit the loop transfer zones, they enter the loop release zone. In the loop release zone the needles are first raised to a height sufficient to cause the loops on the needles to slide past the latches and are then lowered. As described below, the vertical position of a needle cam determines whether the loop is fully transferred to an adjacent needle, or is retained on the selected needle and also transferred to the adjacent needle. Consequently, selected ones of the needles release their respective loop. The needles then leave the loop release zone and again rotate past the feeder mechanism where loops are again placed on all of the needles and the process is repeated.

Figure 2:
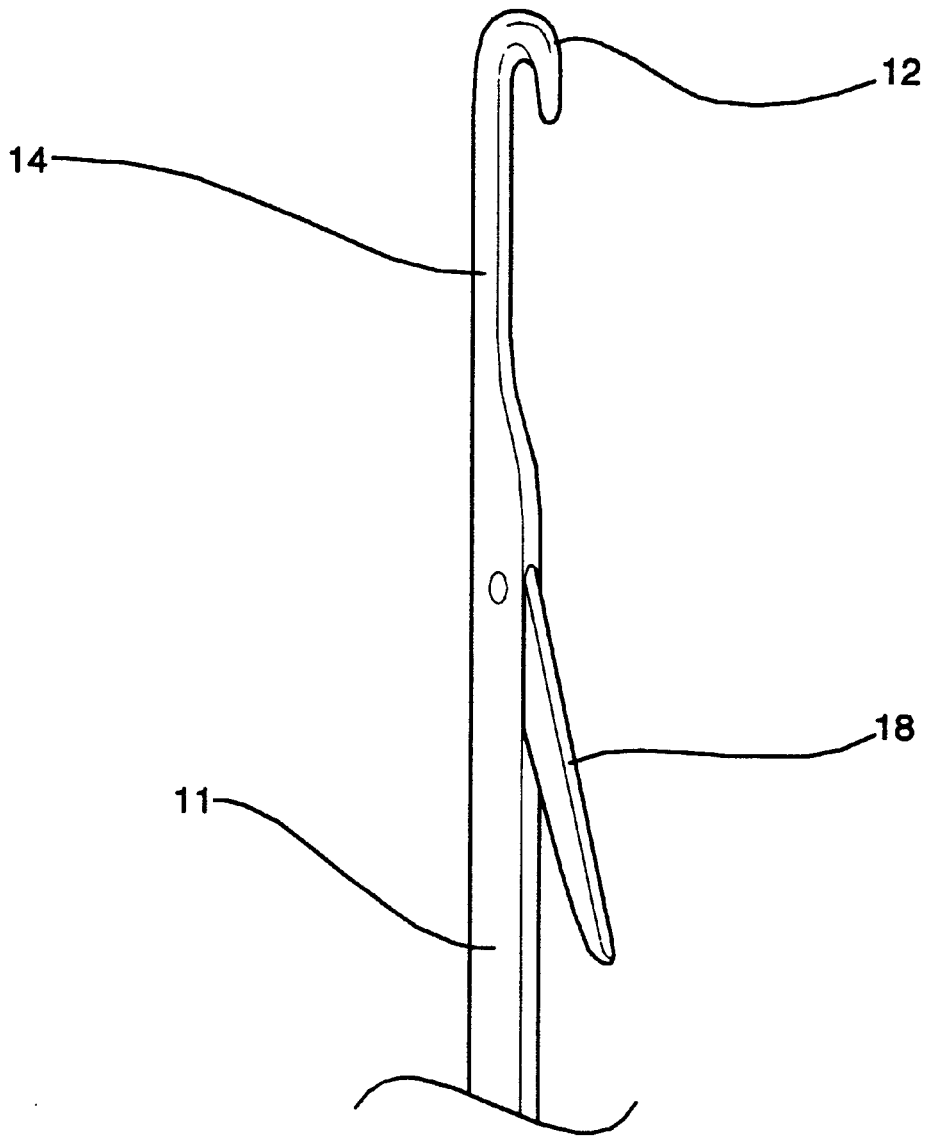
FIG. 2 is an enlarged fragmentary view of the hook area of the needle according to FIG. 1.
Figure 3:
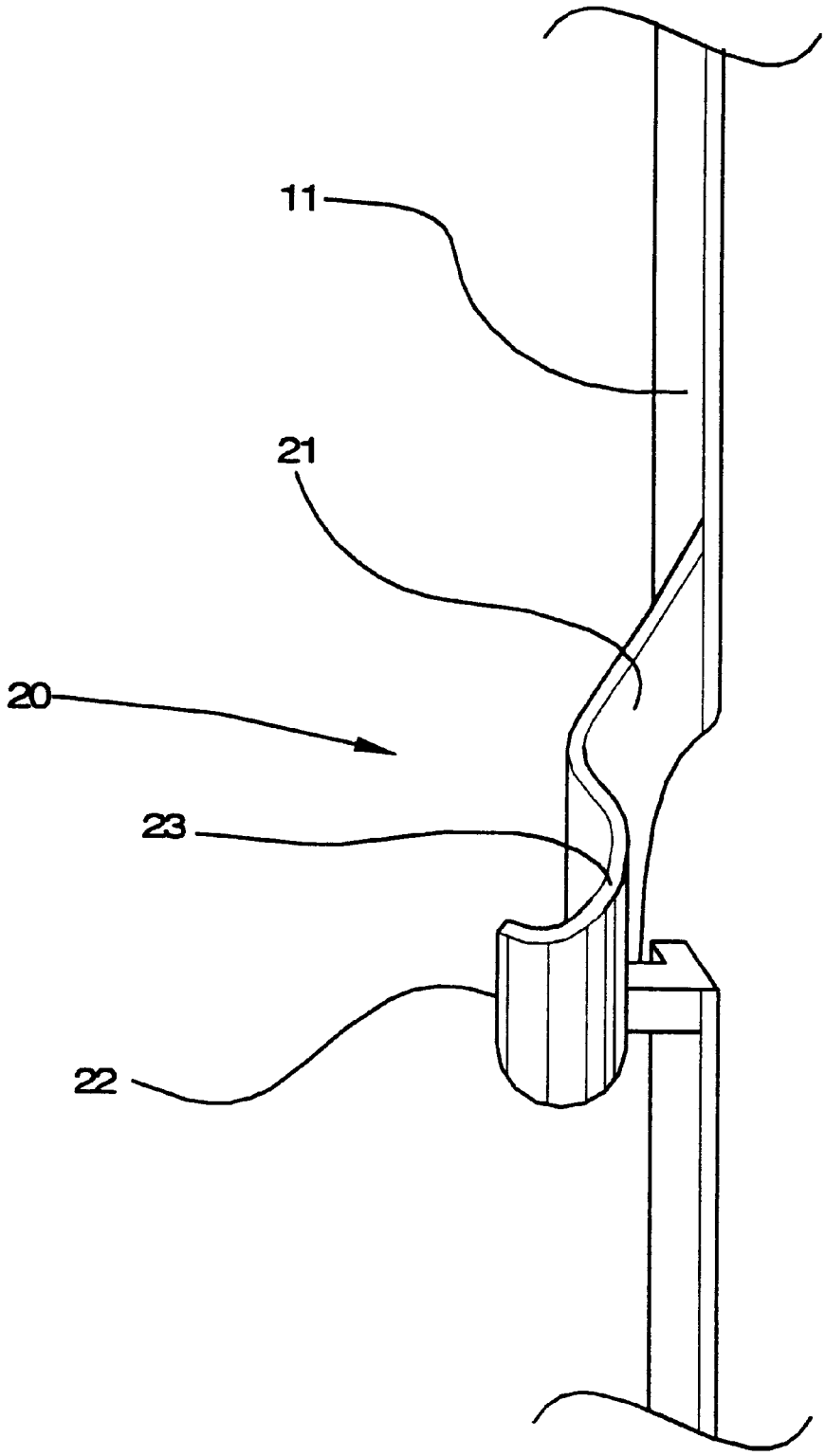
FIG. 3 is an enlarged fragmentary view of the deflector area of the needle according to FIG. 1.

Referring now specifically to the drawings, a needle according to an embodiment of the invention is shown in FIGS. 1–3 and designated generally at broad reference numeral 10. Each needle 10 has an elongate shank 11 having opposed ends. A hook 12 is formed in a top end 14 of the needle shank 11 and a butt 15 is formed in the bottom end 16 of the needle shank 11. Below the hook 12, a latch 18 is pivotally attached to the needle shank 11. The latch 18 pivots between a hook closed position in which the distal end of the latch 18 abuts the distal end of the hook 12 and a hook open position in which the latch 18 abuts the needle shank 11 thereby establishing the hook 12 in an open position. The hook 12 and latch 18 are radially aligned with respect to the needle cylinder of a circular knitting machine with the open side of the needle 10 facing outwardly, as described below.

Hook 10 also includes a deflector 20 which functions to open a loop formed on the hook 10, also described below. The deflector 20 includes a obliquely and downwardly extending extension 21 and an arcuate end portion 22 on the distal end portion of the extension 21 for extending around in non-interfering relation to an adjacent sinker. The arcuate end portion 22 shares an upper deflector surface 23 with the extension, and terminates without an outwardly projecting stop member formed on the bottom of the arcuate end portion. Rather, the loop is maintained on the hook 10 by limiting the upward travel of the needle so that the loop does not move past the bottom of the arcuate end portion 22.

Figure 4:
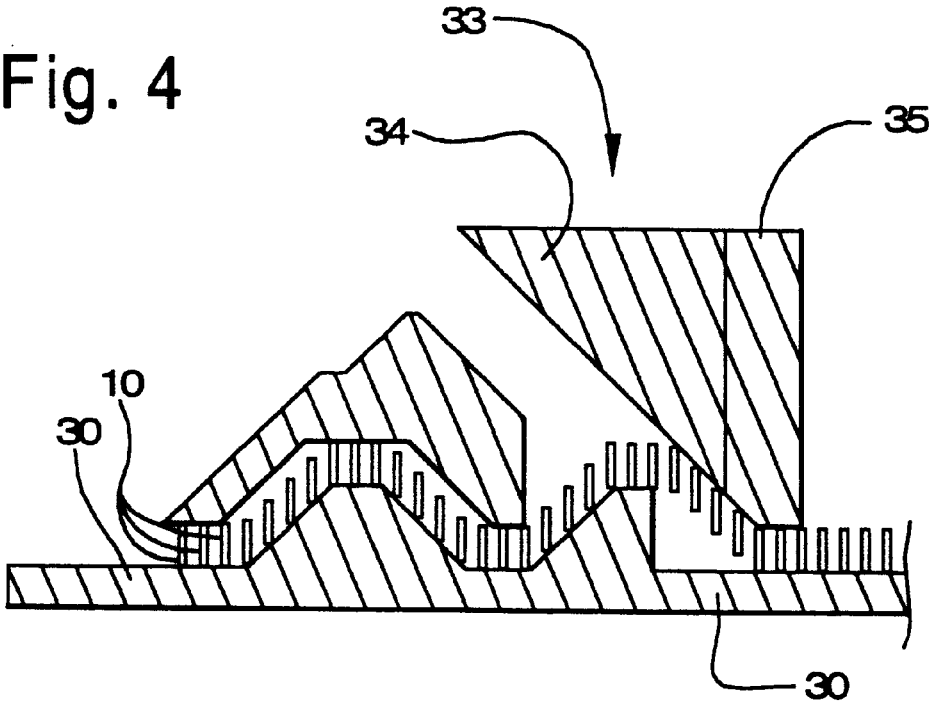
FIG. 4 is a fragmentary view of an adjustable cam arrangement wherein a stitch is released from one needle and transferred to an adjacent needle.
Figure 5:
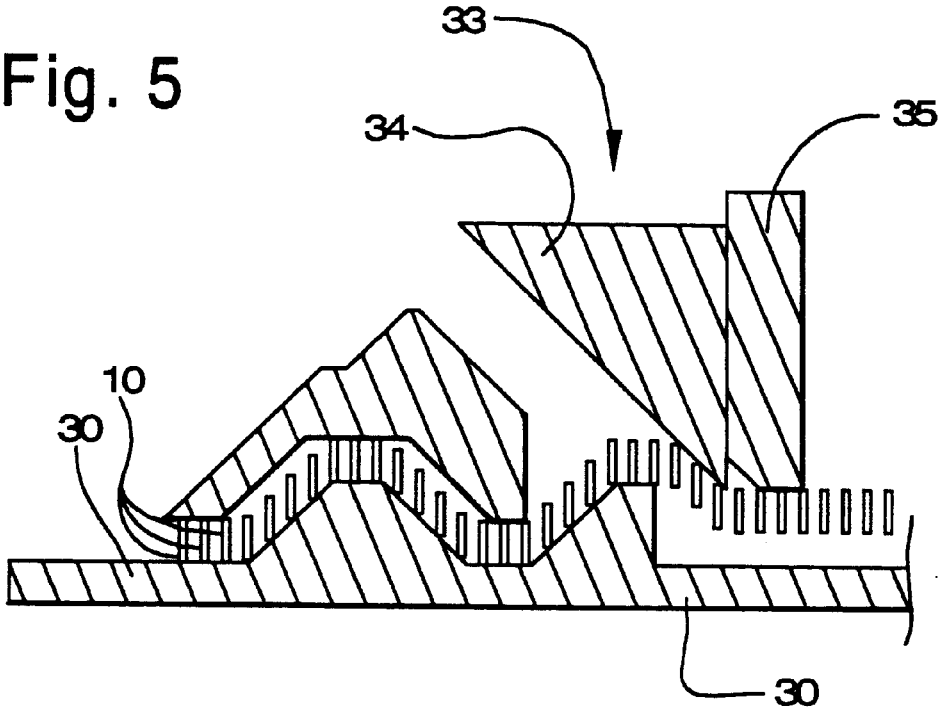
FIG. 5 is a fragmentary view of an adjustable cam arrangement wherein a stitch is not released from a needle while being transferred to an adjacent needle.

Referring now to FIGS. 4 and 5, a segment of the knitting machine is shown schematically to illustrate the manner in which an adjustable cam permits two different stitches to be selectively formed. As the cylinder 30 rotates, the needles 10 carried in the needle slots are moved through vertical movements which create courses of knitting stitches in a conventional manner. A needle cam 33 is provided which includes a stationary segment 34 and a vertically-moveable segment 35. As is observed by comparing FIGS. 4 and 5, the segment 35 has two vertically-distinct positions. In the FIG. 4 position, the needles 10 are lowered to a position where the loop is pulled off of the top of the hook 12 on which it was formed. See FIGS. 8 and 9. In the FIG. 5 position, the needles 10 are lowered to a higher position where the loop is not pulled off of the top of the hook 12 on which it was formed. See FIGS. 6 and 7.

Figure 6:
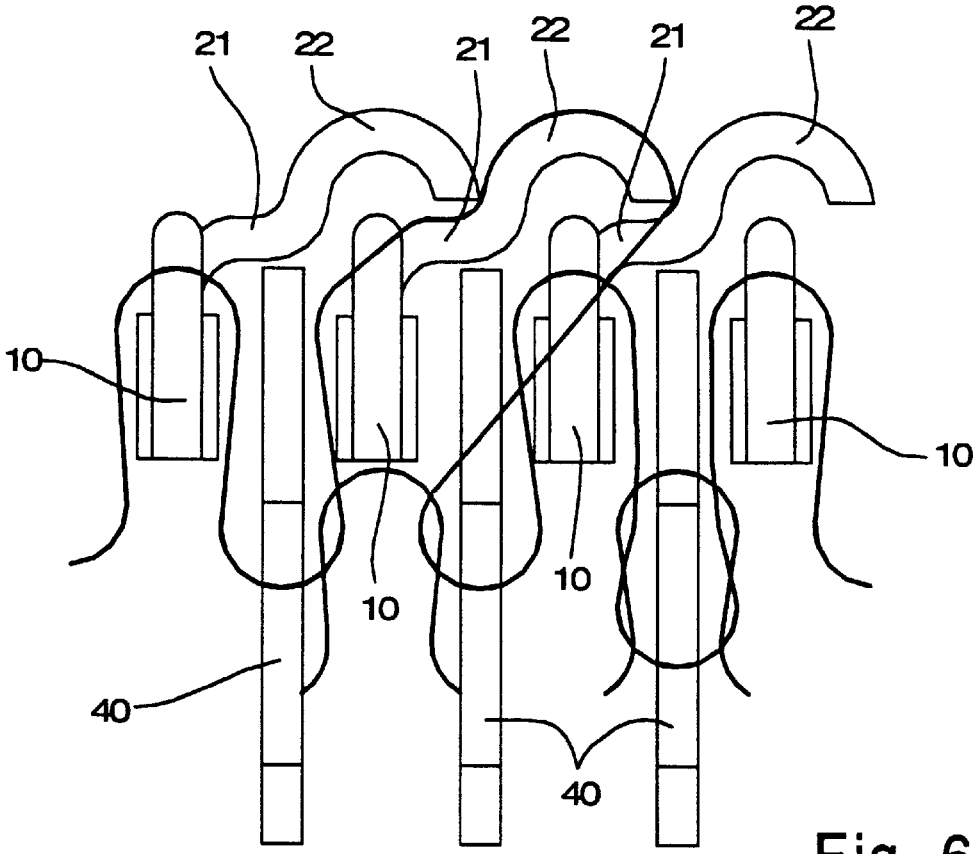
FIG. 6 is a schematic top plan view of adjacent hooks and sinkers showing the creation of the stitch pattern according to the cam location shown in FIG. 4.
Figure 8:
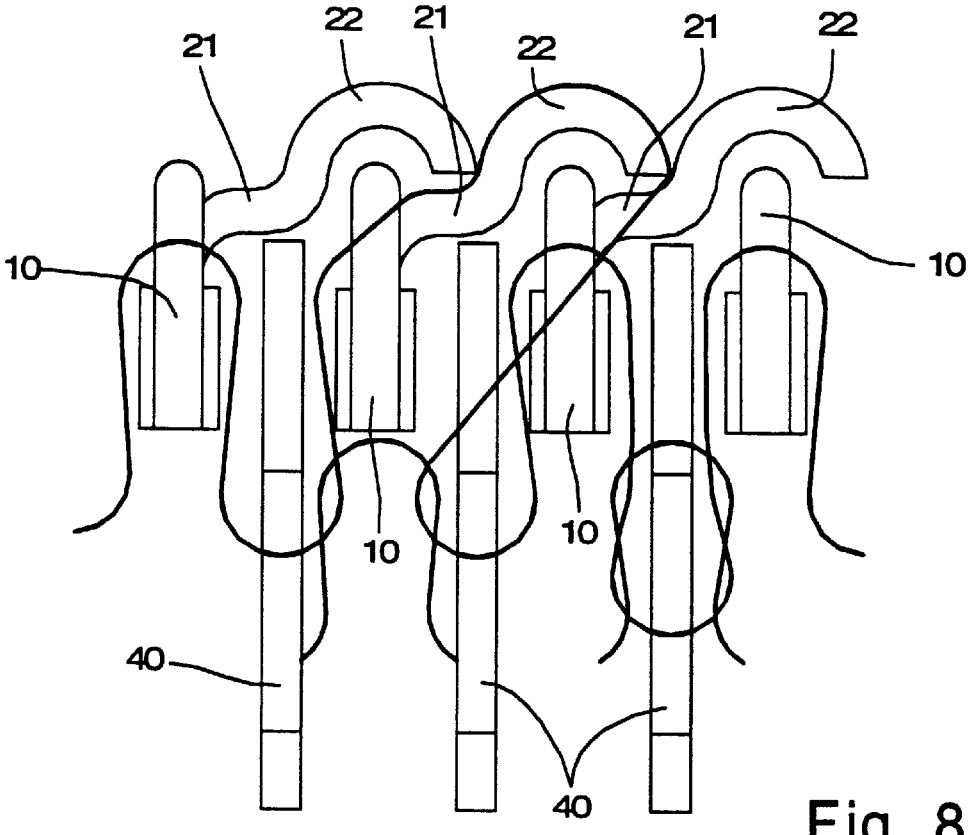
FIG. 8 is a schematic top plan view of adjacent hooks and sinkers showing the creation of the stitch pattern according to the cam location shown in FIG. 5.
Figure 10:
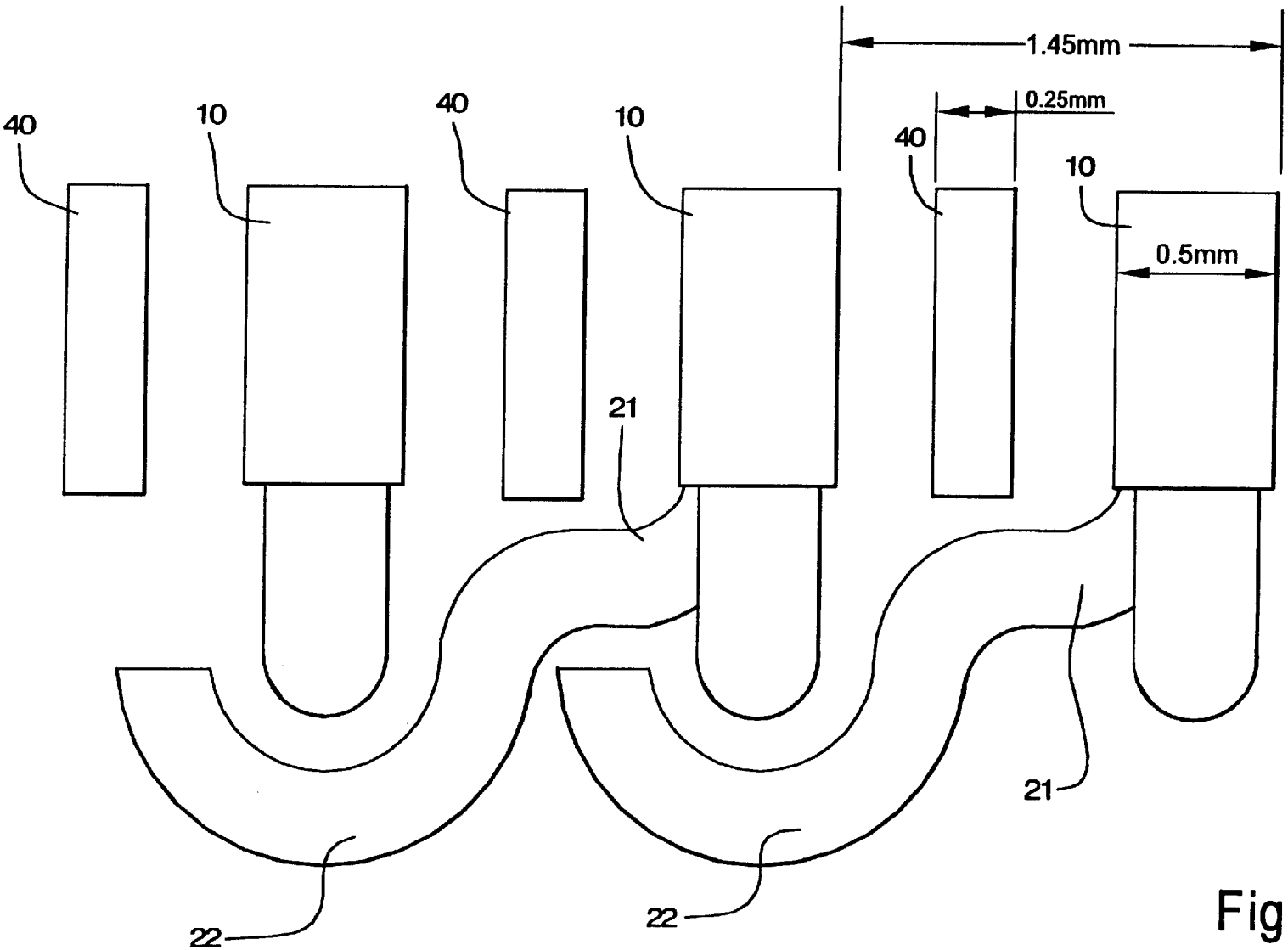
FIG. 10 is a schematic top plan view of the relationship between adjacent needles and sinkers.

Referring now to FIG. 10, the configuration of the deflector 20 in relation to the needle 10 and sinkers 40 is illustrated. As is shown, the arcuate end portion 22 is shaped to extend past the adjacent sinker 40 and sufficiently into the plane of the adjacent needle 10 to permit the loop formed on a selected needle 10 to be transferred to an adjacent needle 10, as also illustrated in FIGS. 6 and 8. Whether the loop is fully transferred or transferred and also kept on the selected needle depends on the position of the needle cam 35, as shown in FIGS. 4 and 5.

Figure 7:
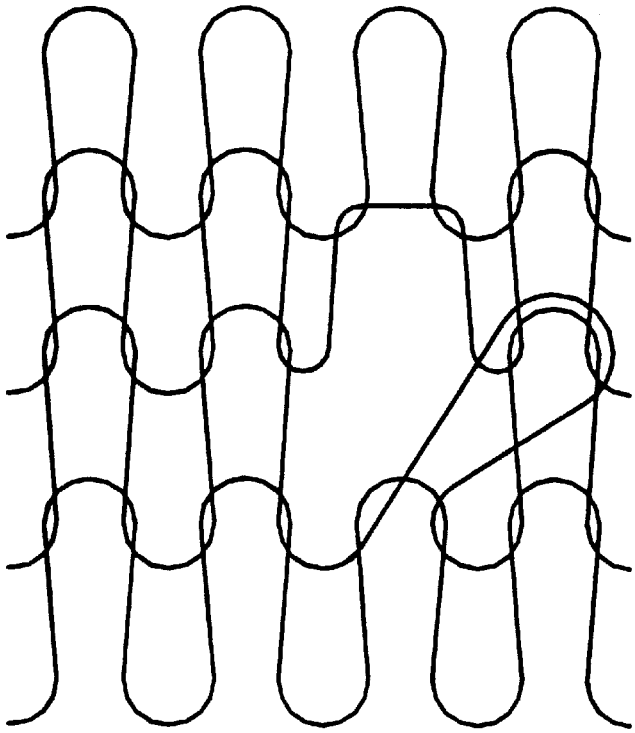
FIG. 7 is a stitch diagram showing the stitch pattern according to the cam location shown in FIG. 4.
Figure 9:
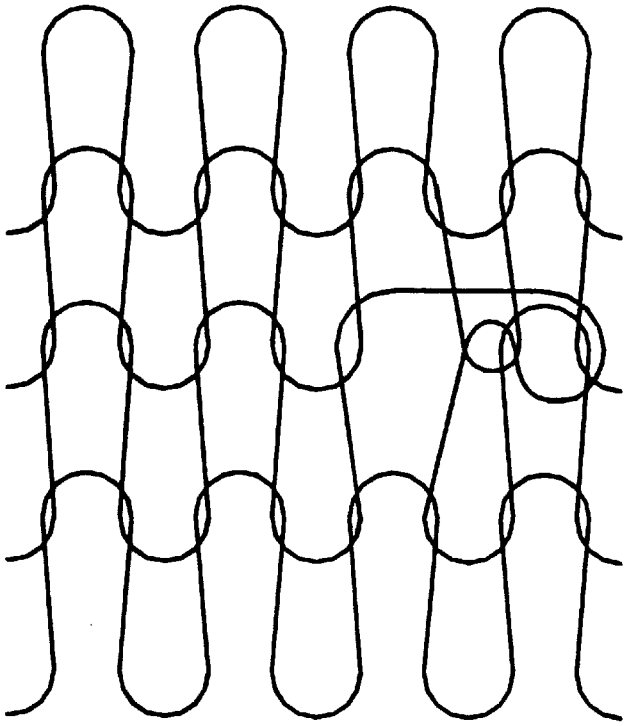
FIG. 9 is a stitch diagram showing the stitch pattern according to the cam location shown in FIG. 5.

The resulting stitches are shown in FIGS. 7 and 9.

Figure 11:
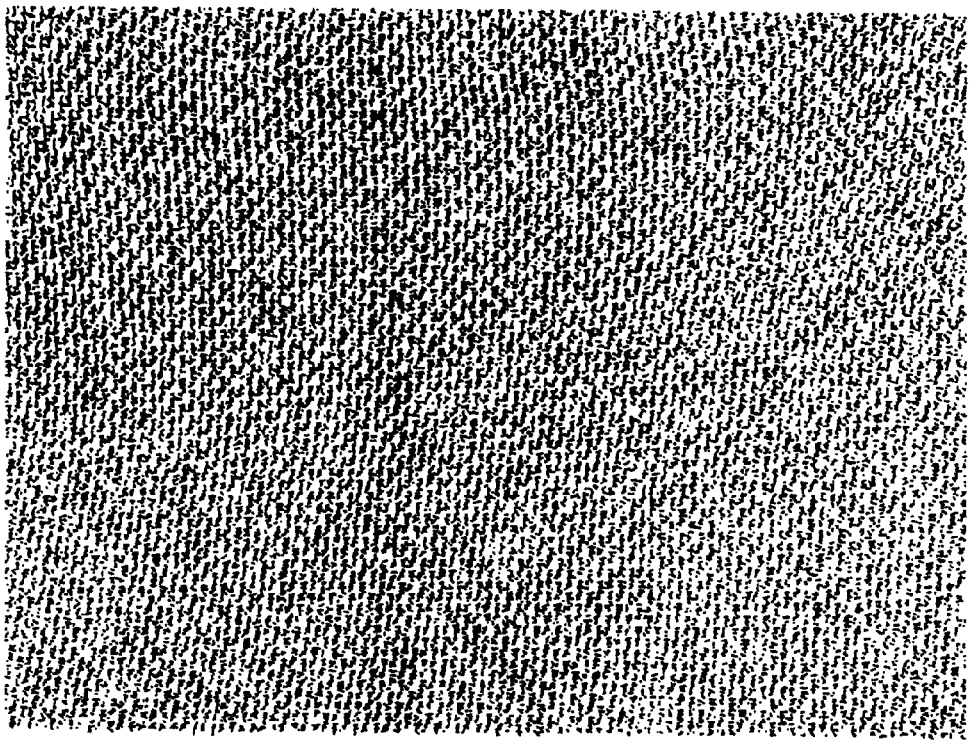
FIG. 11 is a representation of a fabric wherein the loops have been retained on the original needle and transferred to an adjacent needle.
Figure 12:
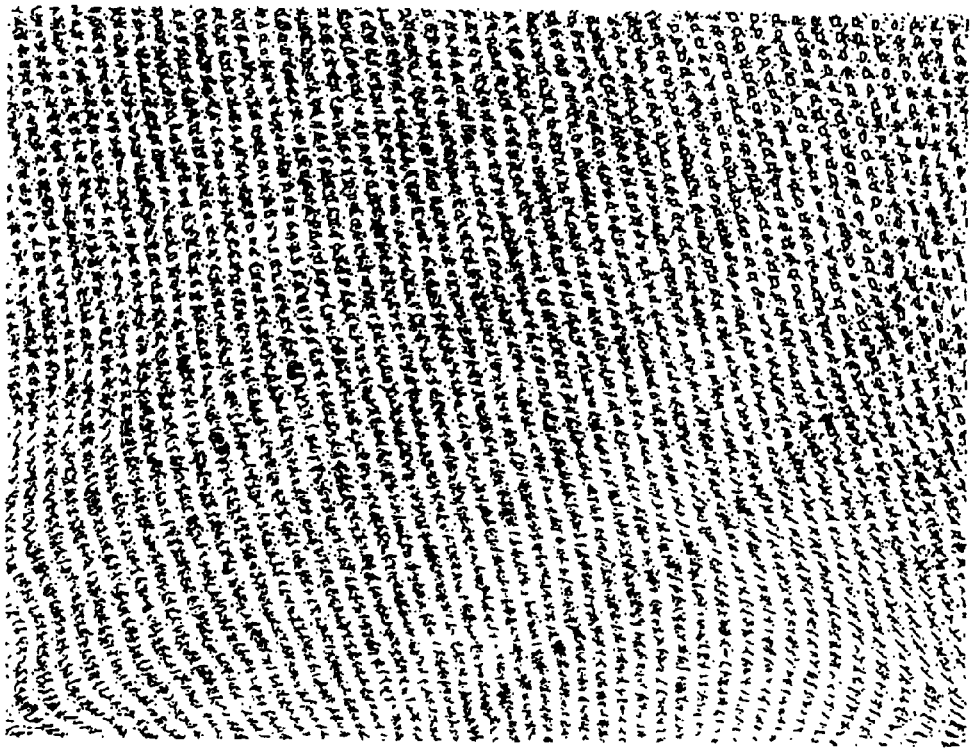
FIG. 12 is a representation of a fabric wherein the loops have been released from the original needle when transferred to an adjacent needle.

Referring now to FIG. 11, an actual segment of fabric having a no-run stitch construction according to FIG. 9 is shown. A more open stitch where the loop is fully transferred to the adjacent needle is shown in FIG. 12. By shifting the needle cam 35 between the positions shown in FIGS. 4 and 5 in accordance with a pattern, a sheer hosiery product or other hosiery product can be produced with an infinitely varied combination of stitches of the types shown in FIGS. 7 and 9.

Figure 13:
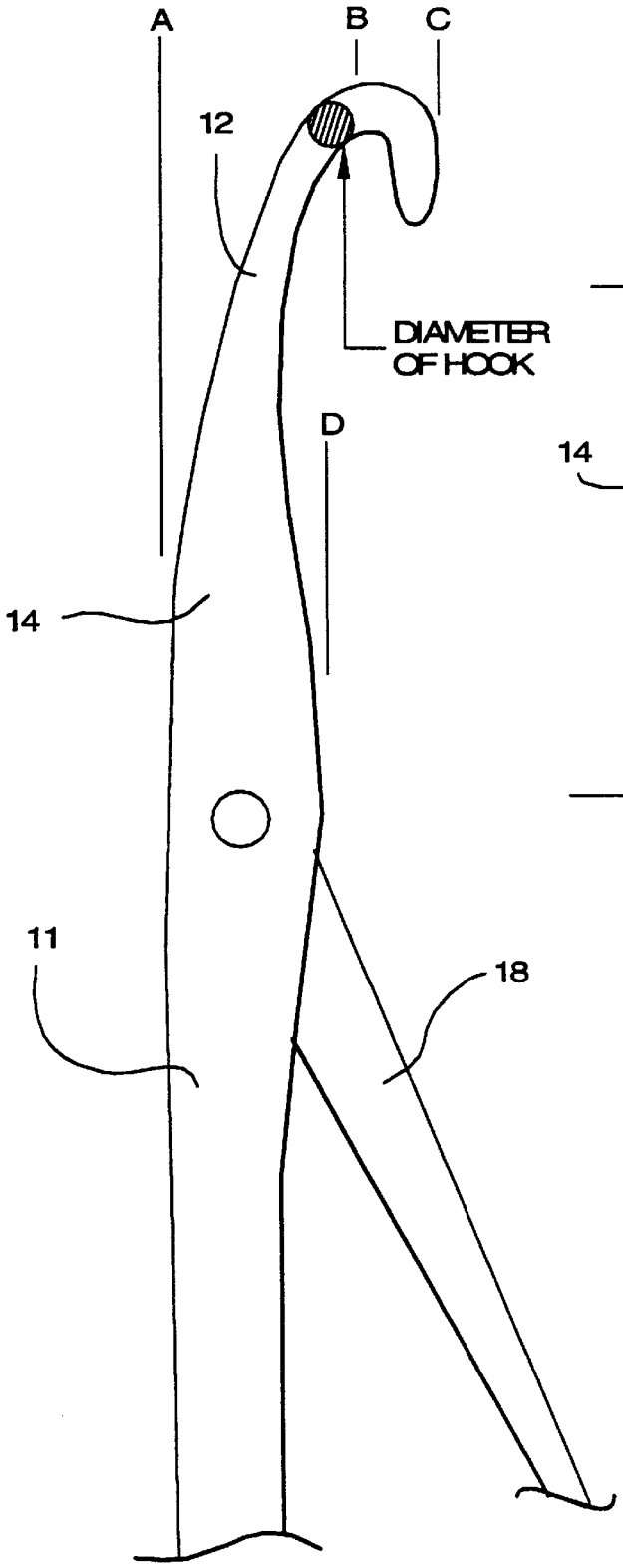
FIG. 13 is a side elevation of the needle according to a preferred embodiment of the invention showing relevant dimensional relationships of the hook.
Figure 14:
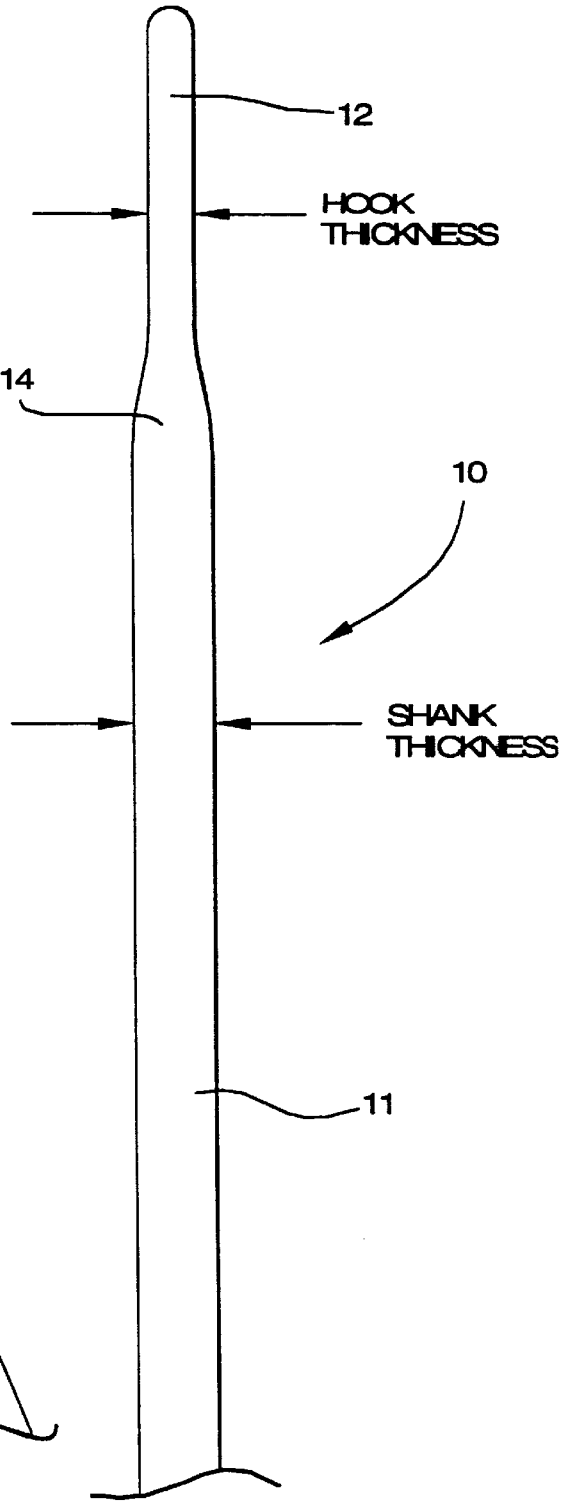
FIG. 14 is a rear elevation of the needle of FIG. 13 showing other relevant dimensional relationships.

Referring now to FIGS. 13 and 14, the geometry of the hook 12 of needle 10 which makes it particularly suitable for use in the apparatus and method of the invention is set out. Note first that hook 12 does not have any form of sharp tip on the top to assist in penetrating the loop being transferred from an adjacent hook. Rather, hook 12 is canted forward so that the forwardmost portion of the hook 12 extends outwardly beyond the plane of the shank 11 and tapers at the top more than with conventional needles. Moreover, the thickness of the hook portion of the needle is reduced, and is less than the thickness of the needle shank 11.

FIGS. 13 and 14 set out that:

1. The dimension B-C is twice the diameter of the hook at the point identified "diameter";
2. The dimension A-B is three times the dimension B-C; and
3. The thickness of the hook 12 is approximately ⅗ the thickness of the shank 11;

where "A" is the plane of the shank 11, "B" is the highest point of the hook 12, "C" is the plane of the front of the hook 12, and "D" is the front of the shank 11 at dimension A-D.

The dimension C-D may be 1.5 times the dimension B-C.

This design permits penetration of the needle into the loops during transfer efficiently and with a very high degree of reliability.

An apparatus and method for producing fine gauge open-work tubular knitted fabrics is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method for creating an opening in tubular knitted fabric articles, comprising the steps of:

(a) providing a knitting machine having a plurality of needles mounted in axial needle slots in a needle cylinder, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and a needle cam mounted for reciprocal movement between first and second vertically-spaced positions wherein:

(i) in the first position the needle cam lowers successive needles to a position where the loop of yarn is released from a selected loop-forming needle and transferred to a transfer needle; and (ii) in the second position the needle cam lowers successive needles to a position where the loop of yarn is transferred to a transfer needle adjacent the selected loop forming needle without being released from the selected loop-forming needle to thereby form a no-run stitch in the knitted fabric;

(b) selecting a needle from which a loop is to be transferred;

(c) enlarging the loop on the selected needle by deflecting the loop out of the vertical plane of the selected needle laterally into the vertical plane of an adjacent needle while the adjacent needle is in a lowered, non-interfering position relative to the deflected loop;

(d) moving the adjacent needle upwardly into the enlarged loop;

(e) when the needle cam is in the first position, removing the selected needle from the deflected loop, whereby the loop is transferred to the adjacent needle thus creating an opening in the fabric; and (f) when the needle cam is in the second position, retaining the deflected loop on the selected needle while the loop is also transferred to the adjacent needle thus creating a no-run opening in the fabric.

2. A method according to claim 1, wherein method comprises the steps of:

(a) creating a predetermined open-work pattern representing a desired pattern of openings in a tubular knitted fabric; and (b) carrying out the steps of claim 1 according to the predetermined pattern thereby creating a tubular knitted fabric having an open-work pattern corresponding to the predetermined pattern.

3. A method according to claim 1 or 2, wherein the machine comprises a fine gauge knitting machine.

4. A method according to claim 3 wherein the step of enlarging the loop on the selected needle comprises the step of moving the selected needle relative to the loop of yarn from the direction of the top of the needle to the bottom of the needle and past a progressively sloping loop contact surface.

5. A method according to claim 4, wherein said knitting machine is a fine gauge hosiery machine.

6. A method according to claim 4, wherein said progressively sloping contact surface comprises a deflector integrally formed on the shank of the needle and extending laterally outwardly from the needle shank towards an adjacent needle.

7. An apparatus for creating an opening in knitted fabric articles, comprising:

(a) a knitting machine having a plurality of needles mounted in axial needle slots in a needle cylinder, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle;

(b) a needle cam mounted for reciprocal movement between first and second vertically-spaced positions wherein:

(i) in the first position the needle cam lowers successive needles to a position where the loop of yarn is released from a selected loop-forming needle and transferred to a transfer needle; and (ii) in the second position the needle cam lowers successive needles to a position where the loop of yarn is transferred to a transfer needle adjacent the selected loop forming needle without being released from the selected loop-forming needle to thereby form a no-run stitch in the knitted fabric;

(iii) whereby, when the needle cam is in the first position, removal of the selected needle from the deflected loop transfers the loop to the adjacent needle thus creating an opening in the fabric; and (c) whereby, when the needle cam is in the second position, the deflected loop is retained on the selected needle while the loop is also transferred to the adjacent needle thus creating a no-run opening in the fabric; and (d) a selector for selecting a needle from which a loop is to be transferred; and (e) a deflector carried by the selected needle for enlarging the loop on the selected needle by deflecting the loop out of the vertical plane of the selected needle laterally into the vertical plane of an adjacent needle while the adjacent needle is in a lowered, non-interfering position relative to the deflected loop.

8. An apparatus according to claim 7, and including:

(a) a patterning apparatus for storing a predetermined open-work pattern representing a desired pattern of openings in a knitted fabric and selecting needles and transferring loops according to the predetermined pattern to thereby creating a knitted fabric having an open-work pattern corresponding to the predetermined pattern.

9. An apparatus according to claim 7 or 8, wherein the machine comprises a fine gauge knitting machine.

10. An apparatus according to claim 9, wherein the selected needle includes a progressively sloping loop contact surface.

11. An apparatus according to claim 10, wherein said progressively sloping contact surface comprises a deflector integrally formed on the shank of the needle and extending laterally outwardly from the needle shank towards an adjacent needle.

12. An apparatus according to claim 7, wherein said knitting machine is a fine gauge hosiery machine.

13. An apparatus according to claim 7, wherein said deflector includes an extension extending outwardly and obliquely-downwardly from the needle shank towards a butt end thereof with an arcuate end portion on a distal end portion of the extension for extending around in non-interfering relation to an adjacent sinker, said arcuate end portion having an upper deflector surface terminating without an outwardly projecting stop member.

14. A method for creating an opening in tubular knitted fabric articles, comprising the steps of:

(a) providing a knitting machine having a plurality of needles mounted in axial needle slots in a needle cylinder, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and first and second needle cams positioned for selectively lowering successive needles to effect loop transfers wherein:

(i) the first cam lowers successive needles in accordance with a predetermined pattern to a position where the loop of yarn is released from a selected loop-forming needle and transferred to a transfer needle; and (ii) the second cam lowers successive needles in accordance with a predetermined pattern to a position where the loop of yarn is transferred to a transfer needle adjacent the selected loop forming needle without being released from the selected loop-forming needle to thereby form a no-run stitch in the knitted fabric;

(b) selecting a needle from which a loop is to be transferred;

(c) enlarging the loop on the selected needle by deflecting the loop out of the vertical plane of the selected needle laterally into the vertical plane of an adjacent needle while the adjacent needle is in a lowered, non-interfering position relative to the deflected loop;

(d) moving the adjacent needle upwardly into the enlarged loop;

(e) when the first needle cam lowers the needle, removing the selected needle from the deflected loop, whereby the loop is transferred to the adjacent needle thus creating an opening in the fabric; and (f) when the second needle cam lowers the needle, retaining the deflected loop on the selected needle while the loop is also transferred to the adjacent needle thus creating a no-run opening in the fabric.

15. An apparatus for creating an opening in knitted fabric articles, comprising:

(a) a knitting machine having a plurality of needles mounted in axial needle slots in a needle cylinder, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle;

(b) first and second needle cams mounted for lowering successive needles to respective loop transfer positions, wherein:

(i) the first needle cam lowers successive needles to a position where the loop of yarn is released from a selected loop-forming needle and transferred to a transfer needle; and (ii) the second needle cam lowers successive needles to a position where the loop of yarn is transferred to a transfer needle adjacent the selected loop forming needle without being released from the selected loop-forming needle to thereby form a no-run stitch in the knitted fabric;

(c) a needle selector for selecting a needle from which a loop is to be transferred in accordance with a predetermined pattern; and (d) a deflector carried by the selected needle for enlarging the loop on the selected needle by deflecting the loop out of the vertical plane of the selected needle laterally into the vertical plane of an adjacent needle while the adjacent needle is in a lowered, non-interfering position relative to the deflected loop.

16. In a knitting needle having a shank with front and back planes A and D, a hook at a top end of the shank having a highest point B, a front plane C and a diameter, a butt adjacent a bottom end of the shank, a pivotally-attached latch for selectively opening and closing the hook, and a deflector for deflecting a loop of yarn being formed by the needle into the vertical plane of an adjacent needle, the improvement comprising the hook having:

(a) a dimension B-C twice the diameter of the hook; and (b) a dimension A-B three times the dimension B-C.

17. In a knitting needle having a shank with front and back planes A and D, a hook at a top end of the shank having a highest point B, a front plane C and a diameter, a butt adjacent a bottom end of the shank, a pivotally-attached latch for selectively opening and closing the hook, and a deflector for deflecting a loop of yarn being formed by the needle into the vertical plane of an adjacent needle, the improvement comprising the hook having:

(a) a dimension B-C twice the diameter of the hook; and (b) a dimension A-B three times the dimension B-C.

18. A needle according to claim 17, wherein the ratio of thickness of the hook to the shank is ⅗.

19. A method for creating an opening in tubular knitted fabric articles, comprising the steps of:

(a) providing a knitting machine having a plurality of needles mounted in needle slots, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle, and first and second needle cams positioned for selectively lowering successive needles to effect loop transfers wherein:

(i) the first cam lowers successive needles in accordance with a predetermined pattern to a position where the loop of yarn is released from a selected loop-forming needle and transferred to a transfer needle; and (ii) the second cam lowers successive needles in accordance with a predetermined pattern to a position where the loop of yarn is transferred to a transfer needle adjacent the selected loop forming needle without being released from the selected loop-forming needle to thereby form a no-run stitch in the knitted fabric;

(b) selecting a needle from which a loop is to be transferred;

(c) enlarging the loop on the selected needle by deflecting the loop out of the vertical plane of the selected needle laterally into the vertical plane of an adjacent needle while the adjacent needle is in a lowered, non-interfering position relative to the deflected loop;

(d) moving the adjacent needle upwardly into the enlarged loop;

(e) when the first needle cam lowers the needle, removing the selected needle from the deflected loop, whereby the loop is transferred to the adjacent needle thus creating an opening in the fabric; and (f) when the second needle cam lowers the needle, retaining the deflected loop on the selected needle while the loop is also transferred to the adjacent needle thus creating a no-run opening in the fabric.

20. An apparatus for creating an opening in knitted fabric articles, comprising:

(a) a knitting machine having a plurality of needles mounted in needle slots, each of said needles having a hook formed in a top end of a needle shank and a latch pivotally mounted on the needle shank below the hook for opening and closing the hook, and including a deflector for deflecting a loop of yarn being formed by a needle into the vertical plane of an adjacent needle;

(b) first and second needle cams mounted for lowering successive needles to respective loop transfer positions, wherein:

(i) the first needle cam lowers successive needles to a position where the loop of yarn is released from a selected loop-forming needle and transferred to a transfer needle; and (ii) the second needle cam lowers successive needles to a position where the loop of yarn is transferred to a transfer needle adjacent the selected loop forming needle without being released from the selected loop-forming needle to thereby form a no-run stitch in the knitted fabric;

(c) a needle selector for selecting a needle from which a loop is to be transferred in accordance with a predetermined pattern; and (d) a deflector carried by the selected needle for enlarging the loop on the selected needle by deflecting the loop out of the vertical plane of the selected needle laterally into the vertical plane of an adjacent needle while the adjacent needle is in a lowered, non-interfering position relative to the deflected loop.

* * * * *